US007527907B2

(12) United States Patent
Nagai

(10) Patent No.: US 7,527,907 B2
(45) Date of Patent: May 5, 2009

(54) TONER FOR ELECTROSTATIC LATENT IMAGE DEVELOPMENT AND METHOD OF MAGNETIC MONOCOMPONENT DEVELOPMENT

(75) Inventor: Takashi Nagai, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 321 days.

(21) Appl. No.: 10/586,562

(22) PCT Filed: Feb. 25, 2005

(86) PCT No.: PCT/JP2005/003104

§ 371 (c)(1),
(2), (4) Date: Jul. 20, 2006

(87) PCT Pub. No.: WO2005/088403

PCT Pub. Date: Sep. 9, 2005

(65) Prior Publication Data

US 2008/0213680 A1 Sep. 4, 2008

(30) Foreign Application Priority Data

Feb. 27, 2004 (JP) ..... 2004-054684

(51) Int. Cl.
*G03G 9/083* (2006.01)

(52) U.S. Cl. ..... 430/106.2; 430/108.6

(58) Field of Classification Search ..... 430/108.7, 430/111.4, 106.2, 108.6
See application file for complete search history.

(56) References Cited

U.S. PATENT DOCUMENTS 6,287,739 B1 * 9/2001 Kawakami et al. ..... 430/108.7
2002/0048468 A1 * 4/2002 Sakaizawa et al. ..... 399/150
2003/0031482 A1 * 2/2003 Nagai et al. ..... 399/267
2003/0054275 A1 * 3/2003 Sugimoto et al. ..... 430/106.1

FOREIGN PATENT DOCUMENTS

| | | | |
|---|---|---|---|
| JP | 10-133424 | A | 5/1998 |
| JP | 2000-206730 | A | 7/2000 |
| JP | 2002-72544 | A | 3/2002 |
| JP | 2002-258522 | A | 9/2002 |
| JP | 2002-278261 | | 9/2002 |
| JP | 3372698 | B | 11/2002 |
| JP | 2003-114545 | A | 4/2003 |
| JP | 2003-149856 | | 5/2003 |
| JP | 2003-255590 | A | 9/2003 |
| JP | 2003-280239 | A | 10/2003 |
| JP | 2003-287920 | A | 10/2003 |
| JP | 2004-170440 | A | 6/2004 |

* cited by examiner

*Primary Examiner*—John L Goodrow
(74) *Attorney, Agent, or Firm*—Carmody & Torrance LLP

(57) ABSTRACT

The present invention provides a toner for electrostatic latent image development and a method of magnetic monocomponent development using the toner which can prevent the toner adhesion to a photoconductor for a long time period and can obtain an image having high quality by maintaining functions of the toner for a long time period or by favorably adjusting the conveying property of the toner on a developing sleeve. In a toner for electrostatic latent image development which contains toner particles and inorganic particles and a method of development using the toner, the toner particles exhibit a shape factor SF-1 which satisfies the relationship 115≦SF-1≦150 and a shape factor SF-2 which satisfies the relationship 115≦SF-2≦145 and, at the same time, a quantity of inorganic particles which are in a floating state is set to a value which falls within a range from 10 weight % to 25 weight % with respect to the total quantity of the inorganic particles.

8 Claims, 3 Drawing Sheets

TONER FOR ELECTROSTATIC LATENT IMAGE DEVELOPMENT AND METHOD OF MAGNETIC MONOCOMPONENT DEVELOPMENT

CROSS REFERENCE TO RELATED APPLICATIONS

This application is a National Stage application of International Application No. PCT/JP2005/003104, filed Feb. 25 2005.

TECHNICAL FIELD

The present invention relates to a toner for electrostatic latent image development and a method of magnetic monocomponent development and, in more detail, to a toner for electrostatic latent image development and a method of magnetic monocomponent development which are favorably applicable to an image forming system which uses an electrophotographic method such as a copying machine, a facsimile or a laser printer.

RELATED ART

In an electrophotographic method, an image is formed as follows. A surface of a photoconductor is uniformly charged with a predetermined polarity and, thereafter, an image exposure is performed by radiating light based on predetermined original information to the surface of the photoconductor thus forming an electrostatic charged image. A toner is made to jump to the electrostatic charged image from a developing sleeve to form a toner image. Then, the toner image is transferred to predetermined paper and, thereafter, the toner image is heated and pressurized by a fixing roller thus forming an image.

The toner for electrostatic latent image development used in the electrophotographic method is usually manufactured as follows. That is, a composition obtained by mixing a coloring agent into a binding resin is melted and mixed by using a two-axial mixer or the like and is cooled and, thereafter, the composition is pulverized and classified. Then, an inorganic oxide or the like is added to the composition and the composition is mixed. It is known that, in such a series of manufacturing steps, a shape of the toner differs depending on a kind of pulverizer or conditions in a pulverizing step, while the shape of the toner largely influences fluidity, charging property, adhesive property or the like of the toner. For example, when the toner has a round shape to some extent, there observed is a tendency that the toner is charged more uniformly and the rise of charging becomes faster.

In view of such circumstances, there has been proposed a developing method which exhibits the excellent transferability and could obtain a high-quality image by adjusting a shape of the toner thus enhancing toner property (for example, see patent document 1).

On the other hand, there has been proposed a toner for electrostatic latent image development in which an average degree of circularity of toner particles is set to a value equal to or more than 0.96 and at least titanium oxide and silica fine particles are added to the toner, wherein a number isolation ratio between the toner particles is set to a value which falls within a range from 1 to 50% and, at the same time, an isolation ratio of titanium oxide is set larger than an isolation ratio of silica (for example, see patent document 2).

[Patent document 1] JP3372698 (claims)
[Patent document 2] JP2002-72544A (claims)

DISCLOSURE OF THE INVENTION

Problems to be Solved by the Invention

However, the toner described in patent document 1 is subjected to surface treatment which uses an additive such as inorganic oxide (silica, titanium oxide or the like) for enhancing fluidity, charging property and the like of the toner and, it has been found that an adhering state of the additive to the toner influences fluidity of toner, charging property of toner, toner's adhesion property to the photoconductor or the like. Accordingly, there exists a drawback that, depending on the shape or the surface state of the toner, the additive is removed from the toner so that properties of the toner may be liable to be easily changed. Further, in the image formation by using the method of magnetic monocomponent development, the charging property of the toner on the developing sleeve and the uniformity of thickness of a toner thin layer on the developing sleeve influence the image quality, while the adhering state of the above-mentioned additive to the toner largely influences the charging property of toner, the uniformity of thickness of the toner layer and the quality of an image.

Further, the toner which is described in patent document 2 basically uses a polymerized toner and hence, there exists a drawback that, the toner containing toner particles having a non-spherical shape exhibits insufficient fluidity and charging property. That is, there exists a drawback that the toner which contains the non-spherical toner particles cannot obtain a desired image density.

Accordingly, in an attempt to overcome the above-mentioned drawbacks, inventors of the present invention have found that, by setting shape factors (SF-1, SF-2) of toner particles to values which fall within predetermined ranges and by setting a quantity of inorganic particles which are in a floating state to a value which falls within a predetermined range, it may be possible to maintain the properties of toner such as the fluidity, the charging property and the adhesive property within desired ranges for a long time period and, at the same time, it may be possible to also favorably maintain the charging property of toner and the uniformity of thickness of the toner thin layer on the developing sleeve within desired ranges. The inventors of the present invention have completed the present invention based on such finding.

That is, it is an object of the present invention to provide a toner for electrostatic latent image development and a method of magnetic monocomponent development which can prevent the toner adhesion to a photoconductor for a long time period and can obtain an image of high quality.

Means for Solving the Problem

The present invention provides a toner for electrostatic latent image development which contains at least toner particles and inorganic particles, wherein the toner particles exhibit a shape factor SF-1 which satisfies the relationship $115 \leqq SF\text{-}1 \leqq 150$ and a shape factor SF-2 which satisfies the relationship $115 \leqq SF\text{-}2 \leqq 145$ and, at the same time, a quantity of inorganic particles which are not adhered to the toner particles and are in a floating state (free state) (quantity of floating inorganic particle) is set to a value which falls within a range from 10 weight % to 25 weight % with respect to a total quantity of the inorganic particles. Due to such a constitution, the present invention can overcome the above-mentioned drawbacks.

That is, according to the toner for electrostatic latent image development of the present invention, by setting the shape factor SF-1 to the value which falls within the predetermined range, it may be possible to assure the fluidity of the toner and hence, it may be possible to enhance the charging property of the toner. Further, also by setting the shape factor SF-2 to the value which falls within the predetermined range, it may be possible to impart proper irregularities to surfaces of the toner particles and hence, it may be possible to assure the adhesive property of the inorganic particles to the surfaces of the toner particles. Accordingly, with the presence of such inorganic particles, it may be possible to lower an adhesive force of the toner to the surface of the photoconductor and, at the same time, it may be possible to enhance the fluidity, the preservation stability of the toner or the like.

On the other hand, according to the toner for electrostatic latent image development of the present invention, by controlling the quantity of the floating inorganic particles which are in a free state to the value which falls within the predetermined range, it maybe possible to suppress the adhesion of the inorganic particles to the toner particles and hence, it may be possible to maintain the excellent toner properties for a long time period.

Further, in forming the toner for electrostatic latent image development of the present invention, the inorganic particles may preferably be formed of grinding particles.

That is, by using a predetermined quantity of grinding particles as the floating inorganic particles, for example, when an amorphous-silicon photoconductor is used as the photoconductor, the inorganic particles may exhibit a predetermined grinding effect to the photoconductor thus preventing an image deletion for a long time period.

Further, in forming the toner for electrostatic latent image development of the present invention, the inorganic particles may preferably be formed of at least one selected from a group consisting of alumina, titanium oxide, magnesium oxide, zinc oxide, strontium titanate and barium titanate.

That is, by using the predetermined kind of inorganic particles, the inorganic particles may exhibit the predetermined grinding effect to the photoconductor and, at the same time, the inorganic particles may impart the predetermined fluidity and the like to the toner thus preventing the toner adhesion for a long time period.

Further, in forming the toner for electrostatic latent image development of the present invention, an adding quantity (total quantity) of the inorganic particles may preferably be set to a value which falls within a range from 0.1 to 10 parts by weight with respect to 100 parts by weight of the toner particles.

That is, by setting the adding quantity of the inorganic particles to the value which falls within such a range, the inorganic particles may exhibit the predetermined grinding effect to the photoconductor and the developing sleeve and, at the same time, the inorganic particles may impart the predetermined fluidity and the like to the toner thus preventing the toner adhesion for a long time period.

Further, in forming the toner for electrostatic latent image development of the present invention, a quantity of the inorganic particles which are in a floating state without being adhered to the toner particles may preferably be measured by using a microwave induced plasma emission spectrophotometry method.

That is, the quantity of the inorganic particles which are in a floating state (floating inorganic particle quantity) in the present invention may be measured by using the microwave induced plasma emission spectrophotometry method. The principle of the measurement uses characteristics of elements that, when different elements exist separately from each other, these elements do not simultaneously emit light, while when these different elements are coupled and exist as one particle, even when elements are different from each other, the elements simultaneously emit light. Further, in measuring the quantity of the inorganic particles, fine particles (toner or inorganic particles) which are caught and collected by a filter are sucked by an aspirator, the spectrophotometry is carried out by introducing an individual fine particle to helium microwave plasma, an element of the fine particle is identified based on a wavelength of an emitted light and, the number of fine particles is measured based on the number of emission of light. Here, in an embodiment 1 and an example 1 which are described later, the method for measuring the floating inorganic particle quantity by using the microwave induced plasma emission spectrophotometry method will be explained in detail.

Further, in forming the toner for electrostatic latent image development of the present invention, the toner may preferably be formed of a magnetic monocomponent toner.

That is, as long as the toner is formed of the magnetic monocomponent toner, by charging the toner without carrier particles, it may be possible to eliminate the influence of the floating inorganic particles which worsens the charging property in the magnetic two-component toner.

Further, another aspect of the present invention is directed to a method of magnetic monocomponent development which forms a predetermined toner image by forming an electrostatic latent image on a photoconductor and developing the electrostatic latent image with a magnetic monocomponent developing toner by using a developing sleeve, wherein the method uses the magnetic monocomponent developing toner in which toner particles exhibit a shape factor SF-1 which satisfies the relationship $115 \leqq SF\text{-}1 \leqq 150$ and a shape factor SF-2 which satisfies the relationship $115 \leqq SF\text{-}2 \leqq 145$ and, at the same time, a quantity of inorganic particles which are not adhered to the toner particles and are in a floating state (quantity of floating inorganic particle) is set to a value which falls within a range from 10 weight % to 25 weight % with respect to a total quantity of the inorganic particles.

That is, according to the method of magnetic monocomponent development of the present invention, with the use of the toner for electrostatic latent image development described above, in forming a toner image by developing the latent image by using the developing sleeve, the electrification of the toner particles on the developing sleeve is not impeded. That is, it is possible to obtain an image of high quality by preventing the floating inorganic particles from deteriorating the toner charging property. Further, it is possible to form the toner thin layer having a uniform thickness on a surface of the developing sleeve by preventing the floating inorganic particles from deteriorating the fluidity of the toner. Still further, it is possible to further suppress the toner adhesion per se to the photoconductor attributed to the floating inorganic particles while ensuring the grinding of the surface of the photoconductor by the toner.

Further, in carrying out the method of the magnetic monocomponent development of the present invention, the surface roughness (Rz) of the developing sleeve may preferably be set to a value which falls within a range from 3.0 μm to 5.5 μm.

That is, by setting the surface roughness (Rz) of the developing sleeve in use to the value which falls within the predetermined range, it is possible to form the toner thin layer having a uniform thickness on a surface of the developing sleeve while ensuring the conveying property of the toner to the surface of the developing sleeve. Accordingly, it may be possible to set the toner density of a toner image developed on the photoconductor to a proper quantity thus enabling the acquisition of an image of higher quality.

Further, in carrying out the method of the magnetic mono-component development of the present invention, the photoconductor may preferably be an amorphous-silicon photoconductor.

That is, with the use of amorphous-silicon photoconductor, over a long time period, it may be possible to lower the fogging density while increasing the image density and, at the same time, the toner adhesion and the adhesion of paper powder maybe reduced.

BEST MODE FOR CARRYING OUT THE INVENTION

First Embodiment

Figure 1:
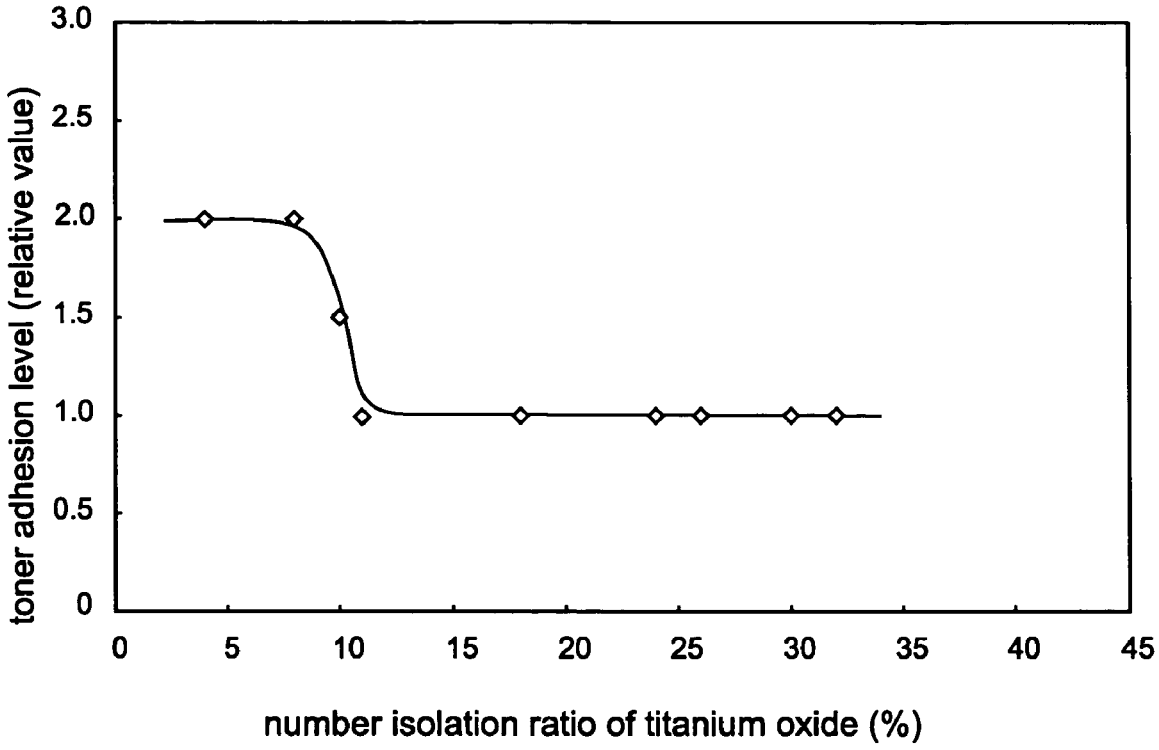
FIG. 1 is a schematic view for explaining the relationship between a quantity of floating inorganic particles made of titanium oxide and the toner's adhesion property.

The first embodiment is directed to a toner for electrostatic latent image development which contains at least toner particles and inorganic particles, wherein the toner particles exhibit a shape factor SF-1 which satisfies the relationship 115≦SF-1≦150 and a shape factor SF-2 which satisfies the relationship 115≦SF-2≦145 and, at the same time, a quantity of inorganic particles which are not adhered to the toner particles and are in a floating state (free state) (quantity of floating inorganic particles) is set to a value which falls within a range from 10 weight % to 25 weight % with respect to a total quantity of the inorganic particles.

Hereinafter, the toner for electrostatic latent image development of the first embodiment is explained by roughly classifying the toner for electrostatic latent image development into the toner particles and the inorganic particles which are added to the toner particles.

1. Toner Particles (1) Shape Factor

In the toner particles of the present invention, SF-1 and SF-2 which are indicative of shape factors satisfy the relationship 115≦SF-1≦150 and the relationship 115≦SF-2≦145 respectively.

The reason is that, by setting SF-1 to the value which falls within such a range, it maybe possible to ensure the fluidity of the toner and, at the same time, it may be possible to enhance the charging property of the toner, while by setting SF-2 to such a value, it may be possible to impart proper irregularities on surfaces of the toner particles thus ensuring the adhesive property of the inorganic particles to the surfaces of the toner particles.

Further, usually, the shape factor SF-1 indicates a degree of roundness of the toner particles, and the shape factor SF-2 indicates a degree of irregularities formed on the toner particles. Further, these shape factors SF-1 and SF-2 may be, for example, measured by an electron microscope and an image analyzer.

To be more specific, the toner is projected on a screen in an enlarged manner (for example, magnification; 1000 times) by using an electron microscope FE-SEM (S-800) made by Hitachi Ltd. Among obtained image information of toner image, a plurality of (for example, 30 to 100 pieces) image information are sampled at random. Next, the sampled image information is introduced into an interface (for example, an image analyzer (LuzexIII) made by NIKOREE Inc.) and an image analysis is applied to the image information thus calculating the shape factors SF-1, SF-2 based on following formulae.

$$\text{SF-1}=(\text{absolute maximum length of particle})^2/\text{projection area of particle}\times\pi/4\times100$$

$$\text{SF-2}=(\text{circumferential length of particle})^2/\text{projection area of particle}\times1/4\pi\times100$$

(2) Binding Resin

Although the binding resin which forms the toner particles is not particularly limited, as the binding resin, a thermoplastic resin such as a styrene resin, an acrylic resin, a styrene-acrylic copolymer resin, a polyolefin resin such as polyethylene or polypropylene, a vinyl chloride resin, a polyester resin, a polyamide resin, a polyurethane resin, a polyvinyl alcohol resin, a vinyl ether resin, an N-vinyl resin or a styrene-butadiene resin may be named.

Among these thermoplastic resins, it may be preferable to use the styrene resin, the styrene-acrylic copolymer resin or the polyester resin.

In the above-mentioned binding resin, a softening point which is measured by a Koka-type flow tester may preferably be set to a value which falls within a range from 80 to 150° C., and the softening point may further preferably be set to a value which falls within a range from 90 to 140° C.

Further, to ensure the fixing property of the toner and to enhance the offset resistance property of the toner, the binding resin may possess a proper molecular weight corresponding to a kind of the using resin.

Further, with respect to a glass transition point (Tg) of the binding resin, by taking the fusion of the toner particles, the lowering of preservation stability, the toner adhesion to the photoconductor, the assurance of low-temperature fixing property and the like into consideration, such a glass transition point may preferably be set to a value which falls within a range from 50 to 70° C., and the glass transition point may further preferably be set to a value which falls within a range from 55 to 65° C. Here, the glass transition point (Tg) maybe obtained based on a change point of specific heat by using a differential scanning calorimeter (DSC). To be more specific, the glass transition point is obtained by measuring a heat absorption curve by using a differential scanning calorimeter DSC-6200 (made by Seiko Instruments Inc.) as a measuring device.

Further, with respect to the binding resin, to enhance the offset resistance property or to increase the toner modulus, a cross-linking agent or a thermosetting resin may preferably be used in combination with the binding resin.

As such a cross-linking agent, for example, an aromatic di-vinyl compound such as divinylbenzene, di-vinylnaphthalene or the like, bifunctional carboxylic ester such as ethylene glycol di (meta) acrylate, a vinyl compound having two, three or more vinyl groups such as divinyl ether or the like may be exemplified.

Further, as the thermosetting resin, an epoxy resin such as a bisphenol A type epoxy resin, a hydrogenation bisphenol A type epoxy resin, a novolactype epoxy resin, a polyalkylene ether epoxy resin, a cyclic aliphatic type epoxy resin or cyanate resin may be used in a single form or in combination of two or more kinds of these resins.

(3) Color Pigment

With respect to kinds of coloring pigments which are added to the toner particles, as a preferable black pigment, for example, carbon black, acetylene black, lamp black or aniline black may be named.

Further, in the same manner, as a preferable yellow pigment, chrome yellow, zinc chromate, cadmium yellow, yellow iron oxide, mineral fast yellow, nickel titan yellow, Naples yellow, naphthol yellow S, Hansa yellow G, Hansa yellow 10G, benzidine yellow G, benzidine yellow GR, quinoline yellow lake, permanent yellow NCG or tartrazine lake may be named. As a preferable orange-colored pigment, shakkou chrome yellow, molybdenum orange, permanent orange GTR, pyrazolone orange, Vulcan orange or indanthren brilliant orange GK may be named. As a preferable red pigment, red iron oxide, cadmium red, red lead, mercury sulfide cadmium, permanent red 4R, lithol red, pyrazolone red, watching red calcium salt, lake red D, brilliant carmine 6B, eosine lake, rhodamine lake B, alizarin lake and brilliant carmine 3B may be named. As a preferable violet pigment, manganese purple, fast violet B, methyl violet lake may be named. As a preferable blue pigment, Prussian blue, cobalt blue, alkali blue lake, Victoria blue lake, phthalocyanine blue, metal-free phthalocyanine blue, phthalocyanine-blue partially chlorinated compound, fast sky blue or indanthren blue BC may be named. As a favorable green pigment, chrome green, chrome oxide, pigment green B, malachite green lake or final yellow green G may be named. As a preferable white pigment, zinc flower, titanium oxide, antimony white, zinc sulfide, and as an extender, barite powder, barium carbonate, clay, silica, white carbon, talc or alumina white may be named.

Here, in adding the coloring pigment to the toner particles, an adding quantity may usually preferably be set to a value which falls within a range from 2 to 20 parts by weight per 100 parts by weight of the binding resin. It is particularly preferable to set the adding quantity to a value which falls within a range form 5 to 15 parts by weight per 100 parts by weight of the binding resin.

(4) Magnetic Powder

Further, the magnetic monocomponent toner may contain magnetic powder in the binding resin, wherein it maybe preferable to mix the magnetic powder in the binding resin such that an adding quantity of the magnetic powder is set to a value which falls within a range from 30 to 120 parts by weight per 100 parts by weight of the binding resin and it may be further preferable to mix the magnetic powder in the binding resin such that the adding quantity of the magnetic powder is set to a value which falls within a range from 50 to 100 parts by weight. This is because that it may be possible to supply the magnetic monocomponent toner alone as a monocomponent toner to the developing region by making use of a magnetic force without using a magnetic carrier or the like. Further, by setting the adding quantity of the magnetic powder within such a range, it may be possible to easily adjust the volume center particle size, the sphericity and also the fine powder quantity of the toner.

Further, as kinds of such magnetic powder, one kind of or the combination of two or more kinds selected from a group consisting triiron tetraoxide ($Fe_3O_4$), iron sesquioxide ($\gamma$-$Fe_2O_3$) iron oxide zinc ($ZnFe_2O_4$) iron oxide yttrium ($Y_3Fe_5O_{12}$), iron oxide cadmium ($CdFe_2O_4$), iron oxide gadolinium ($Gd_3Fe_5O_{12}$), iron oxide copper ($CuFe_2O_4$), iron oxide lead ($PbFe_{12}O_{19}$), iron oxide neodymium ($NdFeO_3$), iron oxide barium ($BaFe_{12}O_{19}$), iron oxide manganese ($MnFe_2O_4$), iron oxide lanthanum ($LaFeO_3$), ferrites, iron powder (Fe), cobalt powder (Co), nickel powder (Ni) and the like may be used, for example.

Further, a shape of particles of the magnetic toner is not particularly limited and hence, the particles are allowed to have an arbitrary shape such as a spherical shape, a cubic shape, an indeterminate shape or the like. Further, it may be preferable to set the average particle size of the magnetic powder to a value which falls within a range from 0.1 to 1 μm, and more particularly to a value which falls within a range from 0.1 to 0.5 μm.

Still further, it may be also preferable to apply the surface treatment to the surface of the magnetic powder by using a titanium coupling agent or a silane coupling agent.

(5) Charge Control Agent

In the toner used in the present invention, to remarkably enhance a charge level or a charge rise characteristic (an index to indicate whether the toner is charged to a fixed charge level in a short time or not) thus providing excellent properties such as excellent durability and excellent stability to the toner, a charge control agent, particularly, a positive charge control agent may be mixed. Further, it may be preferable to set an adding quantity of the charge control agent to a value which falls within a range from 0.1 to 10 parts by weight per 100 parts by weight of the binding resin. It may be further preferable to set the adding quantity of the charge control agent to a value which falls within a range from 1 to 5 parts by weight per 100 parts by weight of the binding resin.

Further, as specific examples of the positive charge control agent, a direct dye made of an azine compound; a nigrosine compound such as nigrosine, nigrosine salt, and nigrosine derivative; an acidic dye made of a nigrosine compound such as nigrosine BK, nigrosine NB, and nigrosine Z; a metallic salt of naphthenate or a higher fatty acid; alkoxylated amine; alkylamide; a quaternary ammonium salt such as benzylmethylhexyldecyl ammonium; and decyltrimethyl ammonium chloride or the like may be exemplified. These components may be used in a single form or in combination of two or more kinds of these components. Particularly, the use of the nigrosine compound is optimum from a viewpoint of the acquisition of more rapid charge rise characteristics.

Further, a resin or an oligomer which contains a quaternary ammonium salt, a resin or an oligomer which contains a carboxylic acid salt, a resin or an oligomer which contains carboxyl group or the like may be also used as a positive charging controlling agent.

(6) Wax

It may be preferable that a wax is mixed into the toner used in the present invention to enhance the fixing property or the offset property. Here, it may be preferable to set an adding quantity of the wax to a value which falls within a range from 1 to 10 parts by weight per 100 parts by weight of the binding resin, and it maybe further preferable to set the adding quantity of the wax to a value which falls within a range from 2 to 5 parts by weight per 100 parts by weight of the binding resin.

The reason is that by setting the adding quantity of the wax to the value which falls within such a range, the fixing property is improved and, at the same time, the offset property and the image smearing may be prevented more effectively. Further, by setting the adding quantity of the wax to the value which falls within such a range, the volume center particle size, the sphericity and the fine powder quantity of the toner may be adjusted more easily.

Further, as the kind of the wax, one kind of or the combination of two or more kinds of the waxes selected from a group consisting of a polyethylene wax, a polypropylene wax, a fluorine type wax, a fischer-tropsch wax, a paraffin wax, an ester wax, a montan wax, a rice wax and the like, for example, may be named.

(7) Manufacturing Method

The toner according to the present invention may be manufactured by conventional methods such as a grain classification method, a mixing and pulverizing method, a method which form particles into a spherical shape by heat treatment or a mechanical impact force after pulverizing and classifying or mixing and pulverizing, a dropping granulation method, a spray granulation method, a dry granulation method (such as a suspension method, a suspension polymerization method, an emulsion polymerization method, a dispersion polymerization method, an interfacial polymerization method and a seed polymerization method, for example), a dissolution suspension method and a phase inversion emulsification method.

Among these methods, a toner preparation method in which a binding resin and various kinds of compounding ingredients are mixed, then, the mixture is melted and mixed by using an extruder and the mixture is further pulverized and classified to prepare the toner having the above-mentioned particle size distribution is preferable. Further, to take the manufacturing equipment, the productivity and the easy realization of the above-mentioned circularity into consideration, the dry granulation method is also preferable. Further, the suspension polymerization method and the emulsion polymerization method are more preferable. Specifically, as the suspension polymerization method, it may be possible to name a method in which a coloring agent and a monomer solution in which additives are dispersed at random are dispersed and suspended in a particle state in a solvent which is not compatible with the solution and the monomers are polymerized in a suspended state thus obtaining the toner and a method in which the monomers are polymerized by the emulsion polymerization in a micell and the like. Here, the central particle size and the sphericity of the toner may be adjusted by properly selecting and combining various manufacturing conditions such as temperature or timing of the heat treatment in the manufacturing step, a magnitude or timing of a force to be applied (such as a mechanical impact force, the number of rotation agitation, a rotational speed), kinds of raw materials and the like.

2. Inorganic Particles (1) Kind

The inorganic particles used in the present invention may preferably be formed of inorganic oxide. To be more specific, the inorganic particles may preferably be made of alumina, titanium oxide, magnesium oxide, zinc oxide, strontium titanate or barium titanate. The titanium oxide may be particularly preferable as a material of the inorganic particles.

Further, an adding quantity of the inorganic oxide may preferably be set to a value which falls within a range from 0.5 to 5 parts by weight with respect to 100 parts by weight of the toner. When the adding quantity of the inorganic oxide is set to a value less than 0.5 parts by weight, the grinding of the surface of the photoconductor is liable to easily become insufficient thus giving rise to a possibility that the image deletion is generated, while when the adding quantity of the inorganic oxide exceeds 5 parts by weight, the fluidity of the toner is liable to be easily lowered thus giving rise to the lowering of the image density, the deterioration of the durability or the like. Further, an average particle size per unit number of the inorganic oxide may preferably be set to a value which falls within a range from 0.01 to 1 μm. When the average particle size of the inorganic oxide is set to a value less than 0.01 μm, the grinding of the surface of the photoconductor is liable to easily become insufficient, while when the average particle size of the inorganic oxide exceeds 1 μm, the fluidity of the toner is liable to be easily lowered.

(2) Other Kinds

Further, when necessary, to the above-mentioned toner, one kind or two or more kinds of additives such as organic fine powder made of colloidal silica, hydrophobic silica, polymethyl methacrylate or the like, a fatty acid metal salt such as zinc stearate may be added in a single form or in combination. Among these additives, it may be preferable to add hydrophobic silica to the toner. By adding these additives, it may be possible to enhance the fluidity, the moisture resistance, the preservation stability and the like of toner.

(3) Adding Quantity

In the present invention, it may be preferable to add the above-mentioned additives within a range which does not impair the original properties of toner. For example, it is preferable to use the additives such that the adding quantity of the additives is set to a value which falls within a range from 0.1 to 10 parts by weight per 100 parts by weight of the toner particles.

The reason is that when the adding quantity of the additives assumes a value below 0.1 parts by weight, the number of the inorganic particles which adhere to the surface of the toner is decreased and hence, the toner adhesion to the surface of the photoconductor is liable to be easily generated. That is, when the quantity of the inorganic particles is decreased, an interaction between the surface of the toner and the surface of the photoconductor is excessively increased.

On the other hand, when the adding quantity of the additives exceeds 10 parts by weight, there may be a case in which the charging property and the fluidity of the toner are worsened.

Accordingly, the adding quantity of the inorganic particle may preferably be set to a value which falls within a range from 0.3 to 5 parts by weight per 100 parts by weight of the toner particles, and the adding quantity of the inorganic particles may further preferably be set to a value which falls within a range from 0.5 to 3 parts by weight.

(4) Quantity of Floating Inorganic Particles

Further, the additives, particularly, the inorganic particles are added to be adhered to the toner particles. Here, in the present invention, although the quantity of the inorganic particles which are floating without being adhered to the toner particles maybe defined as the quantity of the floating inorganic particles, it is necessary to set the quantity of such floating inorganic particles to a value which falls within a range from 10 weight % to 25 weight % with respect to a total quantity of the inorganic particles.

The reason is that when the quantity of the floating inorganic particles assumes a value less than 10 weight %, in both of monocomponent toner and two-component toner, the number of the inorganic particles which are adhered to the surface of the toner is decreased and hence, the toner adhesion to the surface of the photoconductor is liable to be easily generated. That is, the quantity of the floating inorganic particles which are floating without being adhered to the toner particles guarantees a function of spacer particles and hence, when the quantity of the inorganic particles is decreased, an interaction between the surface of the toner and the surface of the photoconductor becomes excessively strong.

On the other hand, when the quantity of the floating inorganic particles exceeds 25 weight %, the charging property and the fluidity of the toner are deteriorated. Here, when the charging property of the toner is deteriorated, there arises a draw back such as the lowering of the image density or the increase of the image fogging with respect to the monocomponent toner and a drawback such as the increase of the image fogging also with respect to the two-component toner. Further, when the fluidity of the toner is deteriorated, with respect to the monocomponent toner, a thickness of the toner thin layer on the surface of the developing sleeve becomes non-uniform thus deteriorating the image quality and, with respect to the two-component toner also, it is difficult to uniformly mix the carrier and the toner and hence, the charging quantity is lowered or the image quality is deteriorated.

Accordingly, with respect to the total inorganic particles, it may be more preferable to set the quantity of the floating inorganic particles which are floating without being adhered to the toner particles to a value which falls within a range from 11 weight % to 23 weight % and, it may be further preferable to set the quantity of the floating inorganic particles to a value which falls within a range from 12 weight % to 21 weight %.

Here, the quantity of the floating inorganic particles may be calculated based on the number of light emission obtained by microwave induced plasma emission spectrophotometry method as described above. For example, when the inorganic particles are made of titanium oxide, assuming the quantity of particles made of titanium oxides in a floating state as the quantity of the floating inorganic particles (%), the quantity of the floating inorganic particles may be obtained from a calculation formula of (the number of light emission of only a Ti atom/the number of light emission of only the Ti atom which emits light simultaneously with a carbon atom+the number of light emission of only the Ti atom)×100. Further, in the same manner, when the inorganic particles are silica fine particles, assuming the quantity of silica fine particles in a floating state as the quantity of the floating inorganic particles (%), the quantity of the floating inorganic particles may be obtained from a calculation formula of (the number of light emission of only an Si atom/the number of light emission of only the Si atom which emits light simultaneously with a carbon atom+the number of light emission of only the Si atom)×100.

That is, "the number of light emission of only the Ti atom" and "the number of light emission of only the Si atom" are values which are obtained by excluding the number of the simultaneous light emission of the Ti atom and the Si atom in respective calculation formulae. Accordingly, by assuming the light emission of the Ti atom and the Si atom after 2.6 msec from the light emission of the carbon atom as the light emission of only the Ti atom and the Si atom and the light emission of the Ti atom and the Si atom which emit light within 2.6 msec as the simultaneous light emission, it is possible to calculate the quantity of the floating inorganic particles from the calculation formula.

Here, the relationship between the quantity of the floating inorganic particles made of titanium oxide and the toner's adhesion property is explained in conjunction with FIG. 1. That is, in FIG. 1, the quantity of the floating inorganic particles made of titanium oxide (weight %) is taken on an axis of abscissas and the toner's adhesion property (relative value) is taken on an axis of ordinates. Further, data in FIG. 1 corresponds to the examples 1 to 5 and the comparison examples 1 to 3.

As may be understood from FIG. 1, when the quantity of the floating inorganic particles made of titanium oxide is equal to or less than 8 weight %, the evaluation of the toner's adhesion property (relative value) assumes a value of 2 or more and is not changed. Further, when the quantity of the floating inorganic particles exceeds 8 weight % and becomes approximately 18 weight %, the evaluation of the toner's adhesion property is remarkably lowered and assumes a value substantially equal to 1. Still further, when the quantity of the floating inorganic particles made of titanium oxide is set to a value which exceeds 18 weight % and becomes approximately 35 weight %, the evaluation of the toner's adhesion property becomes stable and assumes a value approximately equal to 1.

Accordingly, although the relationship between the quantity of the floating inorganic particles and the average particle size of titanium oxide or the like may be taken into consideration, for example, when the average particle size is set to a value which falls within a range from 0.1 to 0.7 μm, by setting the quantity of floating inorganic particles made of titanium oxide to a value which falls within a range from 10 weight % to 25 weight % with respect to the total quantity containing the inorganic particles adhered to the toner particles, it may be possible to improve the toner's adhesion property in a further stable and favorable manner.

Here, as the method for adjusting the additive, particularly, the quantity of the floating inorganic particles of the inorganic particles in the toner, in addition to the method in which the shape of the toner particles is adjusted to the above-mentioned shape factors SF-1 and SF-2, for example, a method which adjusts an average particle size of the unit number of inorganic particles or an adding quantity of inorganic particles with respect to a toner, a method which selects a kind of an agitating mixer for adding processing (such as a Henschel mixer, a Nauta Mixer, a V-shaped mixer, a Turbula mixer, a Hybridizer, an Angmill or the like), a method which adjusts a condition (for example, rotational speed, temperature, period or the like) in mixing an additive with toner particles and the like may be named.

However, in adding two kinds of inorganic particles as additives to the toner, for example, when titanium oxide and silica particles are added as additives to the toner, an adjustment may be performed based on a quantity of floating inorganic particles of titanium oxide which are inorganic particles having a large average particle size of, for example, 0.5 μm. This is because that the titanium oxide having the larger average particle size is liable to be more easily separated from the toner particles than the silica particles having the smaller average particle size, for example, having the average particle size of 12 nm.

3. Others

Further, a two-component toner may be also used as the toner of the present invention. That is, it may be preferable to use a carrier together with the toner of the present invention.

Such a carrier which forms the two-component toner is not particularly limited and various carriers, for example, carriers which cover core particles with a resin may be named. As such a resin which covers the core particles, a (meta) acrylic resin, a styrene resin, a styrene-(meta) acrylic resin, olefin resin (polyethylene, chlorinated polyethylene, polypropylene or the like), a polyester resin (polyethylene terephthalate, polycarbonate or the like), an unsaturated polyester resin, a chloroethylene resin, a polyamide resin, a polyurethane resin, an epoxy resin, a silicone resin, a fluorine resin (polytetrafluoroethylene, polychlorotrifluoroethylene, poly fluorine vinylidene or the like), a phenolic system resin, a xylene resin, a diallyphthalate resin may be used in a single form or in combination of two or more kinds of these resins.

Further, the resin which covers the core particles may contain, when necessary, an additive for adjusting the covering characteristic of the resin such as silica, alumina, carbon black, fatty acid metal salt or the like. As a method for covering the core particles with the resin, for example, various methods including a mechanical mixing method, a spraying method, an immersing method, a fluidized bed method, a rolling method and the like may be named.

Further, the carrier, in general, may properly have a particle size of 20 to 200 μm when expressed by a particle size based on an electron microscope method. The bulk density of the carrier may be suitably adjusted based on the composition of the magnetic body, the surface structure or the like when the carrier is mainly made of a magnetic material. In general, the bulk density of the carrier may preferably be set to a value which falls within a range from 2.4 to 3.0 g/cm$^3$. Here, in using the two-component developer which is formed of the toner and the carrier, it maybe preferable to allow the developer to contain the toner in a state that the toner quantity takes a value which falls within a range of approximately 1 to 20 weight % with respect to the total quantity of the developer.

Second Embodiment

The second embodiment is directed to a method of magnetic monocomponent development which forms a predetermined toner image by forming an electrostatic latent image on a photoconductor and developing the electrostatic latent image with a magnetic monocomponent developing toner by using a developing sleeve, wherein the method uses the magnetic monocomponent developing toner in which toner particles exhibit a shape factor SF-1 which satisfies the relationship 115≦SF-1≦150 and a shape factor SF-2 which satisfies the relationship 115≦SF-2≦145 and, at the same time, a quantity of inorganic particles which are not adhered to the toner particles and are in a floating state (quantity of floating inorganic particle) is set to a value which falls within a range from 10 weight % to 25 weight % with respect to a total quantity of the total inorganic particles.

Hereinafter, the developing method of the second embodiment is explained by focusing on the developing method which includes the image forming method different from the image forming method of the first embodiment.

1. Method of Development

(1) Basic Method of Development

Figure 2:
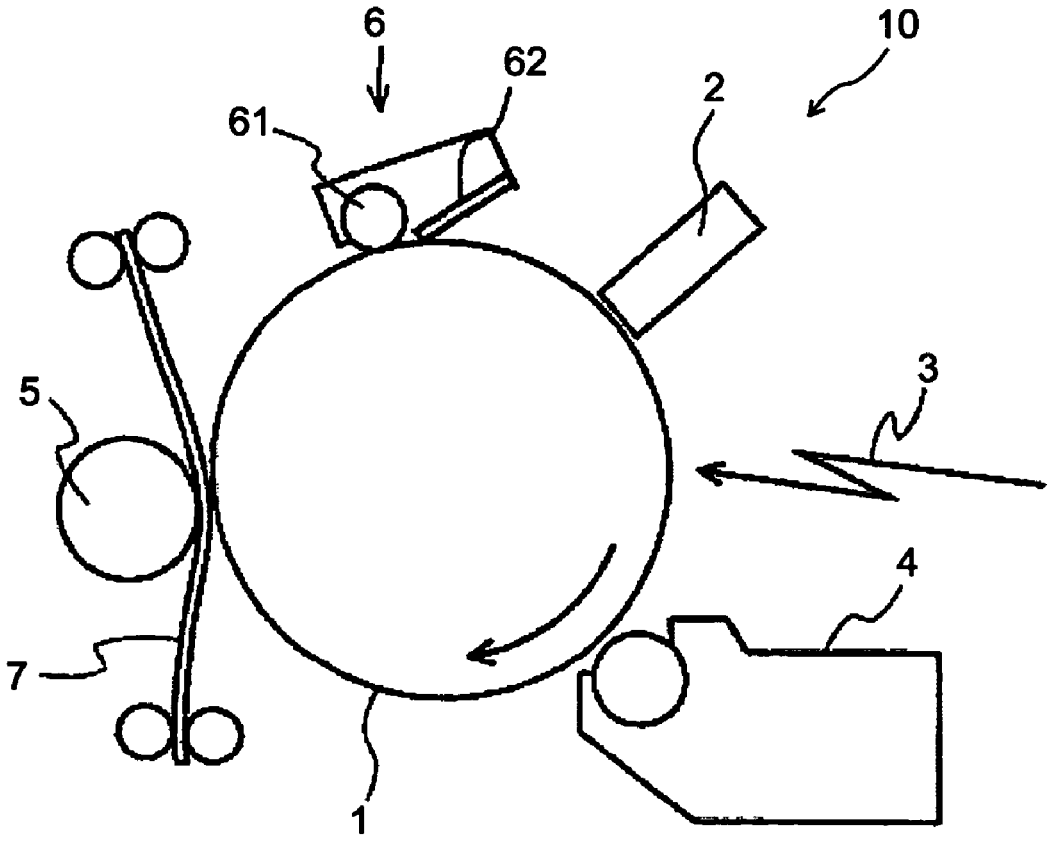
FIG. 2 is a schematic cross-sectional view for explaining an image forming apparatus.
Figure 3:
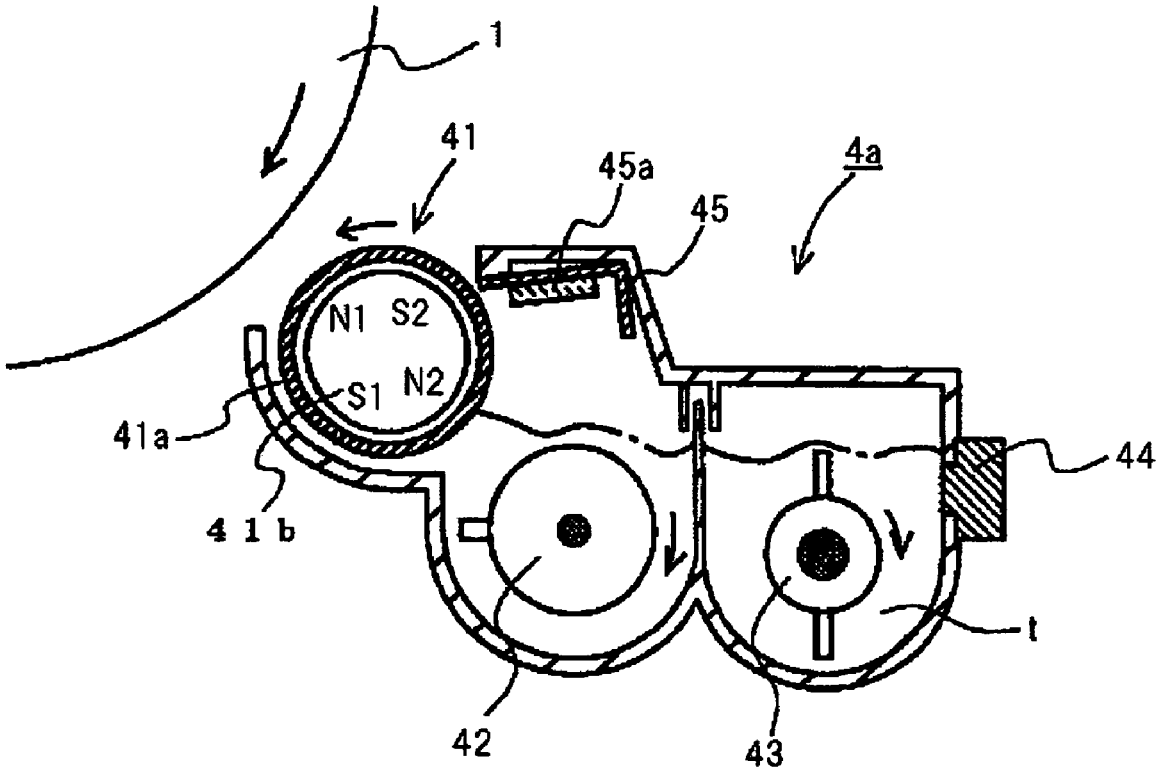
FIG. 3 is a schematic cross-sectional view showing a developing unit which constitutes a part of the image forming apparatus.

When a toner image is formed on a photoconductor 1 by using an image forming apparatus (printer) 10 as shown in FIG. 2, that is, in performing the method of development, in general, a developer which contains a toner is supplied to a developing sleeve 41*a* which incorporates a magnet which is shown in FIG. 3 in detail therein in a state that the developer is tribo-electrified in positive polarity and the developer forms a toner thin layer having a uniform thickness and a uniform density on the developing sleeve 41*a*. Then, when the toner thin layer is conveyed to a developing position which faces the photoconductor 1 in an opposed manner, an AC bias is applied between the photoconductor and the rotational developing sleeve 41*a* and hence, the toner jumps to the photoconductor 1 whereby the toner image is formed on the photoconductor 1.

Here, with respect to the developing sleeve in use in this embodiment, it may be preferable to set a surface roughness (Rz) thereof to a value which falls within a range from 3.0 μm to 5.5 μm.

The reason is that, due to such a constitution, conveying property of the toner to the surface of the developing sleeve is assured and, at the same time, it may be possible to form a toner thin layer having a density (ρ) which is set to a value which falls within a predetermined range and is uniform on the surface of the developing sleeve. Accordingly, it may be possible to adjust the quantity of the toner which is formed on the photoconductor to a proper quantity and, further, it may be possible to realize high resolution and high image quality.

The reason is as follows. When the surface roughness (Rz) of the developing sleeve is smaller than 3.0 μm, there may arise a tendency that the conveying property of the toner to the surface of the developing sleeve is lowered and hence, there may be a case in which the density (ρ) of the toner thin layer on the surface of the developing sleeve is lowered or becomes non-uniform. As a result, the quantity of the toner of the toner image which is developed on the photoconductor takes a value outside the predetermined range.

On the other hand, when the surface roughness (Rz) of the developing sleeve is larger than 5.5 μm, the quantity of the toner in which charging quantity or the like thereof cannot be controlled is increased. Accordingly, the thickness or the density (ρ) of the toner thin layer formed on the developing sleeve becomes non-uniform and, as a result, there may arise a case that it is difficult to properly control the quantity of the toner formed on the photoconductor to a proper quantity.

Particularly, in using an amorphous-silicon photoconductor, when the surface roughness (Rz) of the developing sleeve assumes a value outside a predetermined range, leaking of the toner to the photoconductor drum from projection portions on the sleeve surface may be liable to easily occur and, as a result, a possibility of generation of black spots on an image may be increased.

Accordingly, with respect to the developing sleeve in use in this embodiment, it may be more preferable to set the surface roughness (Rz) of the developing sleeve to a value which falls within a range from 3.1 μm to 5.3 μm, and it may be further preferable to set the surface roughness (Rz) of the developing sleeve to a value which falls within a range from 3.3 μm to 5.1 μm.

Here, the surface roughness (Rz) of the developing sleeve means a ten-point average roughness (Rz) based on JISBO601-1994. Here, the surface roughness may be measured by using a surface roughness measuring instrument Surfcorder SE-30D made by Kosaka Laboratory Ltd., for example.

Further, as a material for forming the developing sleeve, aluminum, stainless steel (SUS) or the like may be named. Particularly, when durability or easiness in controlling the surface roughness (Rz) are taken into consideration, it may be preferable to use stainless steel and, specifically, SUS303, 304, 305, 316 or the like may be named.

Next, a developing means used in the basic developing method is explained.

As such a developing means, for example, the developing unit 4*a* shown in FIG. 3 may be used. The developing unit 4*a* may include a developer carrier 41 in which a magnet roller 41*b* is fixed to and incorporated in the developing sleeve 41*a*, a first agitating conveying member 42 having a spiral-shape and a second agitating member 43 also having a spiral-shape. Further, right above the developing sleeve 41*a*, a blade (developer restricting member) 45 which is provided with a magnet 45*a* on the lower surface thereof is arranged separated from the developing sleeve 41*a* by a predetermined distance. The magnet roller 41*b* which is incorporated in the developing sleeve 41*a* is magnetized with a magnetic pole S2 (first magnetic pole) at a position which faces the blade and is magnetized with a magnetic pole N2 (second magnetic pole) at a position which is rotated by approximately 80° in the clockwise direction from the magnetic pole S2.

On the other hand, the magnetic roller 41*b* is magnetized with a magnetic pole N1 (third magnetic pole) at a position which faces a photoconductor 1 and is magnetized with a magnetic pole S1 (fourth magnetic pole) at a position which is rotated by approximately 80° in the anti-clockwise direction from the magnetic pole N1. Further, a toner sensor 44 for detecting the quantity of the toner is arranged on the right side wall of the second agitating conveying member 43. Accordingly, when the shortage of the quantity of the toner in the inside of the developing apparatus 4*a* is detected by the toner sensor 44, a toner "t" is supplied to the developing apparatus 4*a* from a toner hopper (not shown in the drawing). The supplied toner "t" is conveyed in the depth direction from a reader's side on the drawing while being agitated by the second agitating conveying member 43 and is sent to the first agitating conveying member 42 from the second agitating conveying member 43 at the depth side end portion. Then, the toner "t" is conveyed in the reader's side direction from the depth on the drawing while being agitated by the first agitating conveying member 42 while the toner "t" is supplied to the developing sleeve 41*a*.

That is, the toner "t" which is agitated by the first agitating conveying member 42 and the second agitating conveying member 43 is attracted to the developing sleeve 41*a* by a magnetic force of the magnetic pole N2 which is magnetized to the magnetic roller 41*b*. Then, by the rotation of the developing sleeve, the toner "t" is conveyed to a gap portion between the blade 45 and the developing sleeve 41*a*. When the toner "t" passes through this gap, by the magnetic pole S2 and the blade 45, the quantity of the toner which is sent to the developing part is restricted and, at the same time, the toner thin layer is formed and, further, triboelectrification is applied to the toner "t". It is needless to say that the toner is mainly charged by a friction between the toner "t" and the developing sleeve 41*a* during a period while the toner "t" is conveyed on the developing sleeve 41*a*. Then, by using the toner "t" which is conveyed to a developing part which is a region facing the photoconductor drum 1, an electrostatic latent image on the photoconductor drum 1 is developed.

Here, in the development, a developing bias voltage is applied between the developer supply side (developing sleeve) and the photoconductor 1. As the developing bias voltage (potential applied to the developing sleeve), for example, an alternating bias potential which is obtained by overlapping a DC potential of 250 to 350V and an AC potential of 0.5 to 2.0 KV (amplitude) to each other may be named. Further, as a frequency of the AC potential, a frequency of approximately 1 to 5 Hz may be named.

(2) Image Forming Method

Further, in forming an image by using an image forming apparatus 10 as shown in FIG. 2, first of all, the surface of the photoconductor is uniformly mainly charged. Here, the main charging potential of the surface of the photoconductor at this time is, when the amorphous silicon is used for the photoconductor, properly set to a value which falls within a range from +400 to +500V, for example. Here, the main charging may be performed by an arbitrary means using a corona charging instrument, a charging roller or the like.

Next, based on predetermined image information, light such as laser beams is radiated and an electrostatic latent image is formed on the surface of the photoconductor. That is, by this image exposure, the portion where the laser beams are radiated assumes a low potential. Then, to the electrostatic latent image formed in the above-mentioned manner, the developer containing the toner which is charged in the positive polarity described above jumps and an image is reversely developed. That is, the positively charged toner is adhered to the surface portion of the photoconductor where light is radiated and assumes the low potential and hence, as described above, the jumping developing is performed thus forming a predetermined toner image.

Next, the toner image which is formed on the surface of the photoconductor in this manner is transferred to predetermined paper by a transferring means. As the transferring means, any one of a transferring roller, a transferring belt and a corona charging instrument may be used.

Further, with respect to the transferring roller or the transferring belt, by applying a transferring bias potential having a negative polarity to the transferring roller or the transferring belt, an electric field is generated between the toner image and the transferring means whereby a toner image is transferred to a surface of paper which passes through between the photoconductor and the transferring means.

Here, although not shown in the drawing, it may be also preferable to perform corona charge in a negative polarity on a back surface of the paper by using the corona charging instrument thus transferring the toner image to the paper surface using a generated electric field.

In this case, it may be preferable to use an AC corona charging instrument in combination with a corona charging instrument for transferring for separating paper. That is, since the paper on which the toner image is transferred has the back surface thereof charged in the negative polarity, it may be necessary to separate the paper from the surface of the photoconductor which is charged to the positive polarity. The AC corona charge may facilitate this separation.

Next, the paper on which the toner image is transferred is introduced into a fixing device which is constituted of a pair of heating roller (fixing roller) and pressing roller and the toner is fixed to a paper surface by applying heat and pressure to the toner. On the other hand, the surface of the photoconductor after the toner image is transferred is cleaned by a cleaning device which is constituted of a cleaning blade or a fur brush, the toner which remains on the surface of the photoconductor is removed and electricity is removed from the surface of the photoconductor by radiating light from LED or the like thus completing one cycle of image forming and next image forming is performed thereafter.

2. Toner for Electrostatic Latent Image Development

Also in the method of development of the second embodiment, since a toner for electrostatic latent image development which is substantially equal to the toner for electrostatic latent image which is explained in conjunction with the first embodiment maybe used, a detailed explanation of the toner is omitted here.

Also in the method of development of the second embodiment, since SF-1 and SF-2 which show shape factors of the toner for electrostatic latent image development in use in this embodiment are respectively set to values which fall within predetermined ranges, it may be possible to assure the fluidity of the toner and to enhance the charging property of the toner and, at the same time, it may be possible to apply proper irregularities to surfaces of the toner particles thus assuring an adhesive property of the inorganic particles to the surfaces of the toner particles. Accordingly, it may be possible to lower an adhesive force of the toner to the surface of the photoconductor and, at the same time, to enhance the fluidity, the preservation stability and the like of the toner.

Further, also in the developing method of the second embodiment, by controlling the quantity of the inorganic particles in a floating state (quantity of floating organic particles) to a value which falls within a predetermined range, it is possible to suppress the adhesion of the inorganic particles to the toner thus enabling the maintenance of the excellent toner functions for a long time period.

EXAMPLE

Hereinafter, the toner and the developing method for an electrostatic latent image according to the present invention are explained in detail in accordance with the examples.

Examples 1 to 5 and Comparison Examples 1 to 3

1. Manufacturing of Magnetic Monocomponent Toner (1) Mixing Step using Henschel Mixer 100 parts by weight of a styrene-acrylic resin (binding resin, made by Sanyo Chemical Industries Ltd.), 70.0 parts by weight of magnetic powder (EPT-1000, made by Toda Kogyo Corp.), 5.0 parts by weight of Nigrosine dye (charge control agent, made by Orient Chemical Industries, Ltd., N-01) and 3.0 parts by weight of polypropylene wax (wax, made by Sanyo Chemical Industries Ltd. Umex 100TS) are charged into a Henschel mixer 20B (made by MITSUI MINING COMPACY, LTD.) and these components are mixed at a rotational speed of 2500 rpm for 5 minutes.

(2) Mixing Step with Two-Axial Mixer

Next, the compositions are mixed using a two-axial mixer (PCM-30 made by IKEGAI Ltd.) at a rotational speed of 200 rpm, at a cylinder temperature of 120° C. and with a charge quantity of 6 kg/hour. Further, by using a dram flaker (made by MITSUI MINING COMPACY, LTD.), the compositions are cooled at a speed of 140 mm/sec and with a plate thickness of 3 to 4 mm.

(3) Pulverizing Step using Turbo Mill and Classifying Step using Alpine Classifier Next, the compositions are pulverized by using a turbo mill (T-250 type, made by Turbo Mfg.) in a state that a pulverizing time is changed and, at the same time, the pulverized compositions are classified by an Alpine classifier in a state that the classifying condition is changed thus obtaining toner particles.

Here, the toner "a" corresponding to the example 1 is manufactured by performing the pulverization using the turbo mill at an air quantity of 10 $Nm^3$/min. The toner "b" corresponding to the example 2 is manufactured in the same manner as the toner "a" except for that the pulverization is performed twice. The toner "c" corresponding to the example 3 is manufactured in the same manner as the toner "a" except for that the pulverization by using the turbo mill is performed at an air quantity of 7.5 $Nm^3$/min. The toner "d" corresponding to the comparison example 3 is manufactured in the same manner as the toner "a" except for that the pulverization is performed 3 times. The toner "e" corresponding to the comparison example 4 is manufactured in the same manner as the toner "d" except for that the pulverization by using the turbo mill is performed at an air quantity of 7.5 $Nm^3$/min.

(4) External Addition 100 parts by weight of the toner particles which are obtained respectively, 1.0 part by weight of silica (RA-200H made by NIPPON AEROSIL CO., LTD) and 1.0 part by weight of titanium oxide (ET-500W made by Ishihara Sangyo Kaisha Ltd.,) are charged into a Henschel mixer 20B (made by MITSUI MINING COMPANY, LIMITED) and are mixed for 3 minutes at a mixing rotational speed of 2500 rpm so as to manufacture the respective toners "a" to "e" which correspond to the examples and the comparison examples shown in Table 1.

Here, the toner "f" which corresponds to the comparison example 1 is manufactured in the same manner as the toner "a" except for that the mixing rotational speed of the Henschel mixer is set to 1100 rpm. Further, the toner "g" which corresponds to the comparison example 2 is manufactured in the same manner as the toner "a" except for that the mixing time of the Henschel mixer is set to 1 minute. Further, the toner "h" which corresponds to the comparison example 5 is manufactured in the same manner as the toner "a" except for that silica and the titanium oxide are added by using an Angmill made by Hosokawa Micron Group (mixing for three minutes at 1500 rpm). Further, the toner "i" which corresponds to the example 4 is manufactured in the same manner as the toner "a" except for that the mixing time of the Henschel mixer is set to 5 minutes.

2. Evaluation of the Magnetic Monocomponent Toner (1) Measuring of the Shape Factor 50 respective toner particles are sampled at random and are observed by using an electronic microscope and the obtained images are read by a scanner and are analyzed by using the above-mentioned method. The obtained values are substituted in the above-mentioned conventional formulae to calculate SF-1 and SF-2.

(2) Measuring of Floating Inorganic Particle Quantity

With respect to the respective toners, by using a particle analyzer system (DP-1000, Horiba Ltd.) and by using a helium plasma having a frequency of 2.45 GHz and power of 150 W in a light emitting part of the particle analyzer system, the number A of particles emitted from titanium oxide in a single form and the number B of particles emitted from titanium oxide in a single form and carbon simultaneously (attributed to a binding resin in the toner) are measured.

That is, by using a helium gas containing 0.1% of oxygen, in an atmosphere of a temperature of 23° C. and a moisture of 60% RH, the light emitting frequency of the carbon atom (measuring wavelength: 247.860 nm) is measured at a channel 4 of DP-1000, the light emitting frequency of Si atoms (measuring wavelength: 288.160 nm) is measured at a channel 2 and the light emitting frequency of Ti atoms (measuring wavelength is 232.232 nm) is measured at a channel 3. Further, sampling is performed such that the number of light emission of carbon atom per one scanning is within a range of 1000±200 and the scanning is repeated until the total number of light emission of carbon atom reaches more than 10000 and the numbers of light emission A and B are respectively measured.

Further, based on the obtained numbers of emission A and B as a quantity of the titanium oxide floating without being adhered to the toner particles with respect to a total quantity of toner which contains the titanium oxide particles adhered to the toner particles, a quantity of the floating inorganic particles of the titanium oxide (%) is calculated from a following formula.

$$\text{floating inorganic particle quantity (\%)} = 100 \times A/(A+B)$$

(3) Image Evaluation

With respect to each toner, by using a digital printer (KM-3530, the surface roughness (Rz) of the developing sleeve: 4.3 μm) made by Kyocera Mita Corp. which adopts a developing system shown in FIG. 2, a printing test of 100,000 sheets (using A4 size normal paper, original having 5%-density) is performed under following conditions, and the image density and the fogging density are measured at an initial state (before printing) and after printing 100,000 sheets.

Charge potential: +450V

Developing method: reversal development

Developing bias: AC +200V to +400V

DC 0.25 KV to 2.5 KV

Frequency 2.0 KHz

That is, an image density (ID) of each toner is evaluated by using A4-size paper in a state that a short side of the paper is determined as the conveying direction of the paper and a measuring image which is constituted by three matted image portions with a size of 3×3 cm and arranged on the paper at a center portion in the conveying direction of the paper at an interval of 10 cm perpendicular to the conveying direction of the paper. With respect to one matted image, by using a reflection density meter (TC-6D, made by Tokyo Denshoku Co., Ltd.), 5 points on the image are measured and an average value of 5 sheets is obtained.

Here, it is found that there is no problem in practical use so long as the image density (ID) assumes a value equal to or more than 1.30 in evaluation criteria of image density (ID).

Further, with respect to a fogging density (FD) of each toner, by using a reflection density meter (TC-6D, made by Tokyo Denshoku Co., Ltd.), 5 points in the non-printed portion of one sheet of the above mentioned measuring image printed paper are measured and an average value of 5 sheets is obtained. However, when the measurement of the fogging density of the initial image is impossible, the evaluation is interrupted.

Here, it is found that there is no problem in practical use so long as the fogging density (FD) assumes a value equal to or more than 0.008 in evaluation criteria of fogging density (FD).

(4) Evaluation of Toner Adhesion

By using a digital printer (KM-3530) made by Kyocera Mita Corporation adopting the developing system shown in FIG. 2, 10,000 sheets of whole-area black matted images are formed by means of respective toners under the above-mentioned image forming conditions and an toner adhesion on a last sheet after printing 10,000 sheets is evaluated in accordance with the following criteria by comparing a black matted image after printing 10,000 sheets with an initial image (a first-printed black matted image). That is, when a white spot-like image defect is observed, the image is evaluated as level 2.0 which is indicative of the presence of toner adhesion. When a slight image defect is observed, the image is evaluated as level 1.5 which is indicative of the slight presence of toner adhesion. When an image defect is not observed, the image is evaluated as level 1.0 which is indicative of the absence of toner adhesion.

Level 1.0: absence of toner adhesion

Level 1.5: minimal presence of toner adhesion

Level 2.0: presence of toner adhesion

TABLE 1

| | Kind of Toner | SF-1 (-) | SF-2 (-) | $TiO_2$ Isolation ratio (weight %) | ID (-) Initial | ID (-) After printing 100,000 sheets | FD (-) Initial | FD (-) After printing 100,000 sheets | adhesive property of Toner |
|---|---|---|---|---|---|---|---|---|---|
| Example 1 | Toner a | 128 | 132 | 18 | 1.312 | 1.336 | 0.005 | 0.003 | 1.0 |
| Example 2 | Toner b | 115 | 118 | 24 | 1.338 | 1.352 | 0.005 | 0.001 | 1.0 |
| Example 3 | Toner c | 148 | 145 | 10 | 1.301 | 1.303 | 0.006 | 0.007 | 1.5 |
| Example 4 | Toner i | 125 | 135 | 11 | 1.303 | 1.305 | 0.005 | 0.006 | 1.0 |
| Comparison Example 1 | Toner f | 128 | 131 | 26 | 1.32 | 1.263 | 0.006 | 0.009 | 1.0 |
| Comparison Example 2 | Toner g | 126 | 132 | 30 | 1.304 | 1.253 | 0.007 | 0.01 | 1.0 |
| Comparison Example 3 | Toner d | 102 | 110 | 32 | 1.306 | 1.268 | 0.004 | 0.009 | 1.0 |
| Comparison Example 4 | Toner e | 104 | 154 | 8 | 1.326 | 1.318 | 0.006 | 0.008 | 2.0 |
| Comparison Example 5 | Toner h | 126 | 130 | 4 | 1.313 | 1.328 | 0.006 | 0.005 | 2.0 |

As may be easily understood from a result shown in Table 1, the toners "a" to "c" and "i" which correspond to the examples 1 to 4 have the shape factors SF-1 and SF-2 within the ranges specified in the present invention and have floating inorganic particle quantities which are set to values which fall within the range from 10 to 25 weight %. Accordingly, at both stages of an initial stage and a stage after printing 100,000 sheets, it may be possible to obtain favorable images which satisfy the evaluation criteria in image density as well as fogging density. Further, it may be also possible to effectively prevent the toner adhesion to surface of the photoconductor.

On the other hand, with respect to the toners "f" and "g" which correspond to the comparison examples 1 to 2, since a mixing rotational speed or a mixing time period of the Henschel mixer is insufficient, attributed to the increase of the removal of the inorganic particles from the toner particles, in the same manner as the toner "d", although the adhesion of toner particles to the photoconductor may be suppressed, the image fogging is slightly increased.

Further, with respect to the toner "d" which corresponds to the comparison example 3, both shape factors SF-1 and SF-2 assume values less than ranges specified in this invention. That is, the shapes of the toner particles are close to the spherical shape and, at the same time, a degree of irregularity of the toner particles is small. Accordingly, due to the fact that the adhesive property of the inorganic particles to the toner particles are small and, further, the removal of inorganic particles from the toner particles is increased, although adhesion of the toner particles to the photoconductor is suppressed by a spacing effect, an image fogging is increased. Particularly, due to an insufficient roundness of the toner particles, a high quality image could not be obtained.

Further, with respect to the toner "e" corresponding to the comparison example 4, the shape factor SF-1 assumes a value less than a range specified in the present invention and the shape factor SF-2 assumes a value larger than the range specified in the present invention. That is, the shapes of the toner particles are close to a spherical shape and, at the same time, a degree of irregularity of the toner particles is large. Accordingly, although the adhesive property of the inorganic particles to the toner particles are large and the removal of inorganic particles from the toner particles is suppressed, the floating inorganic particle quantity is excessively small and the interaction between the toner and the photoconductor is increased and hence, the adhesion of the toner particles to the photoconductor is increased. Here, deterioration of the image attributed to the increase of the adhesion of the toner is observed.

Further, with respect to the toner "h" corresponding to the comparison example 5, since the inorganic particles are treated by using an Angmill which is more mechanochemically effective than a Henschel mixer, a ratio of quantity of floating inorganic particles is extremely reduced and hence, the toner adhesion occurs.

INDUSTRIAL APPLICABILITY

According to the toner for electrostatic latent image development and the developing method which uses the toner of the present invention, by controlling the shape factors (SF-1 and SF-2) of the toner particles to values which fall within the predetermined range and, at the same time, by controlling the quantity of the inorganic particle in a floating state to the value which falls within the predetermined range, it may be possible to maintain the performances of the toner over a long time period or to maintain the favorable conveying property of toner on the developing sleeve.

Accordingly, it may be possible to prevent the toner adhesion to the photoconductor and to obtain the high quality images over the long time period and hence, the toner for electrostatic latent image development and the developing method which uses the toner of the present invention are preferably applicable to image forming apparatuses in a wide range including a laser printer, an electrostatic copying machine, an ordinary paper facsimile device, or a composite apparatus having functions of these devices in combination.

The invention claimed is:

1. A toner for electrostatic latent image development which contains at least toner particles and inorganic particles and which is used for an image forming apparatus providing a corona charging instrument, wherein the toner particles exhibit a shape factor SF-1 which satisfies the relationship about $115 \leqq SF\text{-}1 \leqq 150$ and a shape factor SF-2 which satisfies the relationship about $115 \leqq SF\text{-}2 \leqq 145$ and, at the same time, a quantity of inorganic particles which are not adhered to the toner particles and are in a floating state and which is measured by using a microwave induced plasma emission spectrophotometry method, is set to a value which falls within a range from about 10 weight % to 25 weight % with respect to a total quantity of the inorganic particles.

2. The toner for electrostatic latent image development according to claim 1 wherein the inorganic particles are formed of grinding particles.

3. The toner for electrostatic latent image development according to claim 1 wherein the inorganic particles are formed of at least one selected from a group consisting of alumina, titanium oxide, magnesium oxide, zinc oxide, strontium titanate and barium titanate.

4. The toner for electrostatic latent image development according to claim 1 wherein a total quantity of the inorganic particles is set to a value which falls within a range from about 0.1 to 10 parts by weight with respect to 100 parts by weight of the toner particles.

5. The toner for electrostatic latent image development according to claim 1, wherein the toner is formed of a magnetic monocomponent toner.

6. A method of magnetic monocomponent development which is used for an image forming apparatus providing a corona charging instrument and which forms a predetermined toner image by forming an electrostatic latent image on a photoconductor and developing the electrostatic latent image with a magnetic monocomponent developing toner by using a developing sleeve, wherein the method uses the magnetic monocomponent developing toner in which toner particles exhibit a shape factor SF-1 which satisfies the relationship about $115 \leqq SF\text{-}1 \leqq 150$ and a shape factor SF-2 which satisfies the relationship about $115 \leqq SF\text{-}2 \leqq 145$ and, at the same time, a quantity of inorganic particles which are not adhered to the toner particles and are in a floating state and which is measured by using a microwave induced plasma emission spectrophotometry method, is set to a value which falls within a range from about 10 weight % to 25 weight % with respect to a total quantity of the inorganic particles.

7. The method of magnetic monocomponent development according to claim 6, wherein the surface roughness (Rz) of the developing sleeve is set to a value which falls within a range from about 3.0 μm to 5.5 μm.

8. The method of magnetic monocomponent development according to claim 6, wherein the photoconductor is an amorphous-silicon photoconductor.

* * * * *